US006701935B1

(12) United States Patent
Oliver

(10) Patent No.: US 6,701,935 B1
(45) Date of Patent: Mar. 9, 2004

(54) INCORPORATION OF SMOKE-MODIFYING AGENTS IN SMOKING MATERIAL RODS

(75) Inventor: Richard Oliver, Southampton (GB)

(73) Assignee: British American Tobacco (Investments) LTD, London (GB)

( * ) Notice: Subject to any disclaimer, the term of this patent is extended or adjusted under 35 U.S.C. 154(b) by 0 days.

(21) Appl. No.: 09/762,532

(22) PCT Filed: Aug. 6, 1999

(86) PCT No.: PCT/GB99/02600

§ 371 (c)(1),
(2), (4) Date: Feb. 8, 2001

(87) PCT Pub. No.: WO00/08959

PCT Pub. Date: Feb. 24, 2000

(30) Foreign Application Priority Data

Aug. 14, 1998 (GB) ..... 9817605

(51) Int. Cl.[7] ..... A24D 3/04

(52) U.S. Cl. ..... 131/335; 131/352; 131/353; 131/359; 131/84.1; 131/360; 131/364; 131/108

(58) Field of Search ..... 131/335, 352, 131/353, 359, 84.1, 360, 364, 108, 110, 274

(56) References Cited

U.S. PATENT DOCUMENTS 4,219,031 A 8/1980 Rainer et al.
4,727,888 A 3/1988 Luke
5,144,966 A 9/1992 Washington

FOREIGN PATENT DOCUMENTS

EP 0 405 929 A2 2/1991
EP 0 558 447 A1 1/1993
GB 2 070 409 A 9/1981
GB 2 260 887 A 5/1993

*Primary Examiner*—Steven P. Griffin
*Assistant Examiner*—Mark Halpern
(74) *Attorney, Agent, or Firm*—Jones Tullar & Cooper, PC

(57) ABSTRACT

A method of incorporating fibriform smoke-modifying material in smoking material rod, wherein fibriform smoke-modifying material is fed longitudinally thereof to a rod making machine (1). The longitudinal feed path in the machine is in a travel direction of the smoking material deposition run of the suction band (3) of the machine. The fibriform material (13) is either constrained by guide means (15) in the machine to follow a feed path spaced from the run (31) of the suction band against the suction force towards the run or the feed path of the fibriform smoke-modifying material is caused to ascend toward the deposition run under the influence of the suction force towards the run, until at a predetermined distance along the deposition run the fibriform material becomes supported and is subsequently maintained at a predetermined distance from the run by particulate smoking material (20) deposited on the run. Thereafter further smoking material (20') is deposited on the deposition run.

26 Claims, 3 Drawing Sheets

Fig.2.

INCORPORATION OF SMOKE-MODIFYING AGENTS IN SMOKING MATERIAL RODS

BACKGROUND OF THE INVENTION

The present invention relates to the incorporation of fibriform material comprising smoke-modifying agents in smoking material rods.

It has heretofore been proposed to incorporate a filament comprising smoke-modifying agents in a smoking material rod, such as a tobacco rod. For example, in GB 2 070 409 it was proposed that a filament comprising smoke-modifying agents be incorporated in the smoking material rod by insertion of the filament at the tongue of the garniture of a tobacco rod making machine. As would be apparent to those skilled in the art, insertion of a filament at the tongue of the garniture would inevitably require bending of the filament, which bending may be undesirable under certain circumstances, such as when a filament of lesser flexibility is used. Furthermore, when inserting filaments at the tongue of the garniture, the precise location of the filament laterally of the resulting tobacco rod is not easily regulated and also, disadvantageously, the flow of tobacco at the garniture could be disturbed.

U.S. Pat. No. 5,144,966 discloses a flavourant-release additive in the form of a filament for incorporation in the combustible filler of cigarette products and a method of production of such a filament. In U.S. Pat. No. 5,144,966at Column 3, lines 20–23 it is stated, in respect of the incorporation of filaments in filler rod during formulation of the rod on a rod making machine, that the filament, on a reel module, can be fed continuously to the moving cigarette wrapper strip in co-ordination with the combustible filler feed stream. As is well known to those persons skilled in the art, in cigarette manufacture the cigarette wrapper strip is fed directly into the garniture of the tobacco rod making machine. U.S. Pat. No. 5,144,966 clearly teaches that the filament is fed to the moving cigarette wrapper strip and thus that the filament is fed to the garniture of the tobacco rod making machine, much in the same manner as that disclosed in GB 2 070 409 above. The disadvantages of such a system, as outlined above, include the lateral positioning of the filament in the completed tobacco rod being substantially unregulated and the introduction of inflexible filaments being difficult.

The present invention is predicated upon Applicant's realisation that it is important that when a smoke-modifying agent is incorporated in a tobacco rod such as to be distributed along the rod, the agent is located at an axial zone of the rod. Such axial zone location of the agent ensures maximal transfer efficiency of the agent into mainstream smoke. Furthermore, the location of the agent at an axial zone of the rod ensures a minimal propensity of spot formation on the tobacco rod wrapper. In addition, ash formation in cigarettes comprising a tobacco rod having a smoke-modifying agent at an axial zone thereof resembles that of conventional cigarettes.

U.S. Pat. No. 4,219,031 teaches a method of making a smoking article, which smoking article comprises a gas permeable, self-supporting central core consisting essentially of a carbonised cellulose rod, which core is circumscribed by tobacco. Reference is made in Column 5, line 19 to the feeding of a carbonised rod into cigarette fabricating equipment, which equipment, it is said, acts to arrange cut tobacco shreds around the periphery of the core (rod). However, there is no teaching as to how this could be achieved practically.

Finally, in U.S. Pat. No. 4,727,888 a method is disclosed for making a smoking article rod, for which method two tobacco rod making machines are juxtaposed with the respective garnitures in alignment. The first making machine produces a tobacco rod the diameter of which is smaller than that of a conventional cigarette. This small diameter tobacco rod is then fed from the first making machine directly into the second making machine, in which further tobacco is fed to and around the small diameter rod and a paper wrapper is applied about the layer of further tobacco, thus to form a coaxial tobacco rod of conventional exterior circumferential dimension.

SUMMARY OF THE INVENTION

It is an object of the present invention to provide for fibriform smoke-modifying material in a smoking material rod.

The present invention provides, according to a first aspect thereof, a method of incorporating fibriform smoke-modifying material in smoking material rod, wherein fibriform smoke-modifying material is fed longitudinally thereof to a rod making machine, the longitudinal feed path in said machine being in a travel direction of the smoking material deposition run of the suction band of said machine, said feed path of said fibriform smoke-modifying material being caused to ascend towards said deposition run under the influence of the suction force towards said run until at a predetermined distance along said deposition run said fibriform material becomes supported and is subsequently maintained at a predetermined distance from said run by particulate smoking material deposited on said run, thereafter further said smoking material being deposited on said run.

The present invention further provides, according to a second aspect thereof, a method of incorporating fibriform smoke-modifying material in smoking material rod, wherein fibriform smoke-modifying material is fed longitudinally thereof to a rod making machine, the feed path in said machine extending in the travel direction of the smoking material deposition run of the suction band of said machine, said fibriform material being constrained by guide means in said machine to follow said feed path spaced from said run of said suction band against the suction force towards said run until at a predetermined distance along said deposition run said fibriform material becomes supported and is subsequently maintained at a predetermined distance from said run by particulate smoking material deposited on said run, thereafter further said smoking material being deposited on said run.

The fibriform smoke-modifying material suitably takes the form of a single, continuous fibriform element. Alternatively, in respect of the second aspect of the present invention the fibriform smoke-modifying material could be fed to and into contact with the particulate smoking material in the form of a sequence of discrete fibriform elements. In the latter case each element, in the feed path of the elements, may be at each end thereof in contact with the respective ends of the next adjacent elements of the sequence thereof, or may be spaced therefrom.

In that particulate smoking material is deposited on the deposition run of the suction band both before and after the fibriform smoke-modifying material becomes supported at, or substantially at, the said predetermined distance from the run by smoking material on the run, in the carpet of smoking material as finally formed at the downstream end of the run the element(s) is disposed other than at the upper or lower boundary of the carpet. The position of the element(s) relatively of the upper and lower boundaries is determined in accordance with the location along the deposition run of the suction band at which the element(s) becomes supported by the smoking material deposited on said run. Suitably, the said location is selected to be in a mid zone of that portion of the deposition run which extends from the location at which smoking material is first deposited on the deposition run to the downstream location at which the carpet of smoking material is finally formed, i.e. the location at which deposition is terminated. Thus, for example, tee said location may be situate between about 25% and about 60% of the length of the said portion of the deposition run as taken from the location at which smoking material is first deposited on the run, and preferably between about 25% and about 40% of that length.

Suitably too, if the fibriform smoke-modifying material takes the form of a single only, continuous fibriform element, the feed path of the fibriform element in the making machine is aligned, or substantially aligned, with the plan view longitudinal centre line of the carpet on the deposition run of the suction band; that is to say, the element is, throughout the feed path thereof in the making machine, equi-distant, or substantially equidistant, the suction band guide rails of the machine. As will be readily apparent to those of ordinary skill in the art, if two, say, continuous fibriform elements are fed to the making machine, the respective feed paths thereof are in the proximity of the said longitudinal centre line of the carpet. By virtue of the said location being appropriately positioned in a mid zone of the said portion of the deposition run, and, in the case of a single element, the element being aligned with the aforesaid plan view centre line of the carpet, it may be readily arranged that the element extends axially of the subsequently formed smoking material rod.

According to the first aspect of the present invention the degree of ascent of the feed path of the fibriform smoke-modifying material is preferably only gradual (for example not more than about 5° from the horizontal, and preferably about 1° to 2° from the horizontal). As will be realised by those skilled in the art, the degree of rigidity of the fibriform smoke-modifying material is to be selected such that the fibriform material is not, upon being exposed to said suction force, thereby immediately displaced upwardly onto the run of the suction band, but maintains a gradual ascent until at said predetermined distance along said deposition run the fibriform smoke-modifying material becomes supported by particulate smoking material deposited on the run. As will also be readily appreciated by persons skilled in the art, an important variable in ensuring that the fibriform smoke-modifying material initially becomes supported by the particulate smoking material deposited on said run at said predetermined distance along said deposition run is the distance between said fibriform smoke-modifying material at the point of entry thereof to the chimney of the making machine and the deposition run of the suction band.

According to the second aspect of the present invention, the feed path to which the fibriform smoke-modifying material is constrained by the guide means may extend at a constant vertical distance from the deposition run of the suction band. Alternatively, the guide means is so configured that the feed path ascends towards the deposition run, in which case the guide means terminates at the aforesaid distance from the deposition run, or somewhat short thereof. The path of ascent can be linear or, alternatively, the path of ascent can be curvilinear, an ogee curve for example.

Also, preferably the guide means of the second aspect of the present invention comprises rigid, elongate body means, which body means is provided with a guidance bore. The guidance bore is configured and dimensioned so as to ensure unimpeded movement through the bore of fibriform smoke-modifying material. Suitably, the elongate body is of generally tubular conformation. Thus, for example, the elongate body may take the form of a tube, the exterior diameter of which tube is suitably within a range of about 0.5 mm to about 3 mm in a case in which the fibriform smoke-modifying material takes the form of a single fibriform element. Conveniently, the exterior diameter of the tube is about 1.5 mm where it is the case that the single fibriform element is of an exterior diameter of about 0.5–1 mm. Thus it may be that the elongate body generally resembles a syringe needle.

Instead of the guidance bore being dimensioned appropriately for the movement therethrough of a single fibriform element, in the case in which two or more elements are fed simultaneously to the making machine, a single, larger guidance bore may be employed for the guided movement therethrough of the two or more elements in side-by-side disposition. Alternatively, each of the two or more elements is guided in a respective bore of a plurality of guidance bores. A single or plurality of elongate body means may provide the plurality of guidance bores.

Advantageously, the exterior conformation of the single elongate body means or the plurality thereof of the guide means is such as to minimise the obstacle presented, by the presence of the body means, to the flow of particulate smoking material to the deposition run of the suction band of the making machine. Thus, for example, a streamlined fairing may be provided, which fairing extends upwardly and/or downwardly of the elongate body means. Alternatively, or in addition, the flow of smoking material to the deposition run in the region of the guide means is aided by the provision of a modified flow path boundary configuration. Thus in the vicinity of the guide means the flow path to each side thereof may be enlarged, i.e. the lateral distance between the guide means and the path boundary to each side thereof is increased. In addition or as an alternative to these measures, the degree of suction at that portion of the deposition run overlying the guide means is modified relatively to that obtaining at the remainder of the deposition run. The degree of suction exerted in way of the guide means may, for example, be maintained at an elevated level and/or may be continuously varied.

Advantageously, the fibriform smoke-modifying element (s) is conveyed continuously to the point of entry to the rod making machine by feed means. The feed means may comprise a pair of opposed feed rollers, which rollers are operable to draw a fibriform element from a wound storage source thereof. Suitably, the speed of at least one of the feed rollers can be varied relative to speed of the rod making machine. Thus, the fibriform element is fed to the rod making machine at a fixed speed in relation to that at which the rod making machine is run.

BRIEF DESCRIPTION OF THE DRAWINGS

In order that the present invention may be clearly understood and readily carried into effect, reference will now be made, by way of example, to the accompanying diagrammatic drawings, in which.

Figure 1:
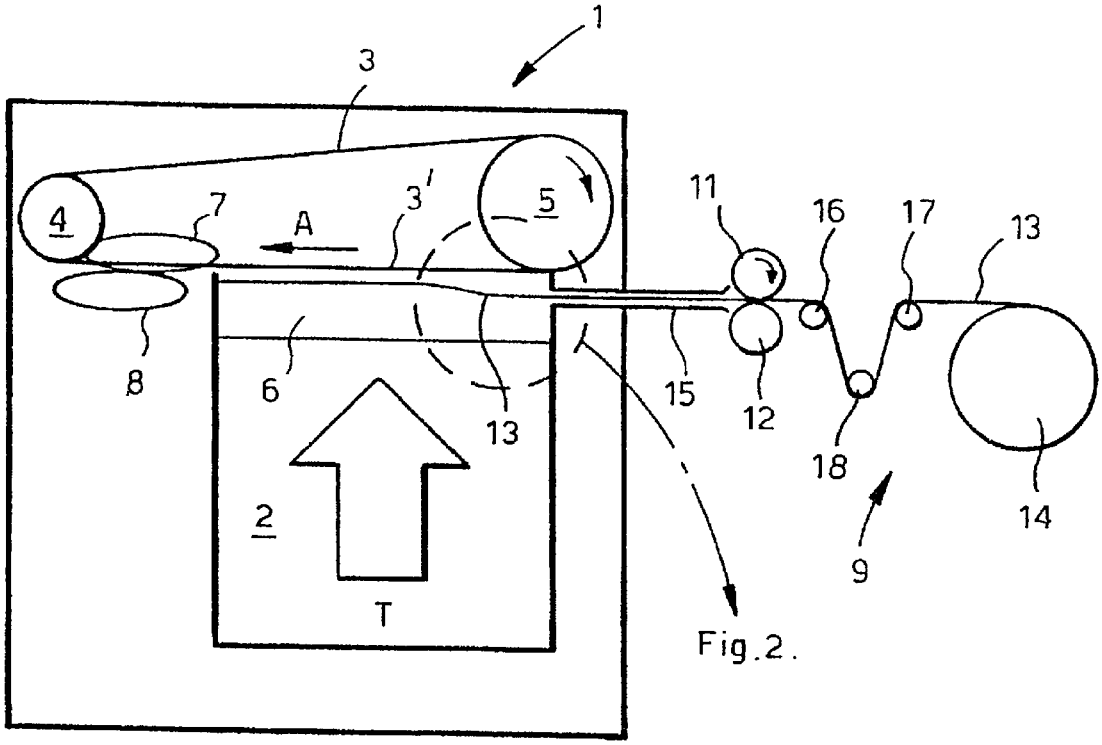
FIG. 1 shows an upstream section of a tobacco rod making machine and associated equipment according to the first aspect of the present invention.

Reference numerals are, wherever possible, consistent between the Figures.

DETAILED DESCRIPTION OF THE PREFERRED EMBODIMENTS

Figure 3:
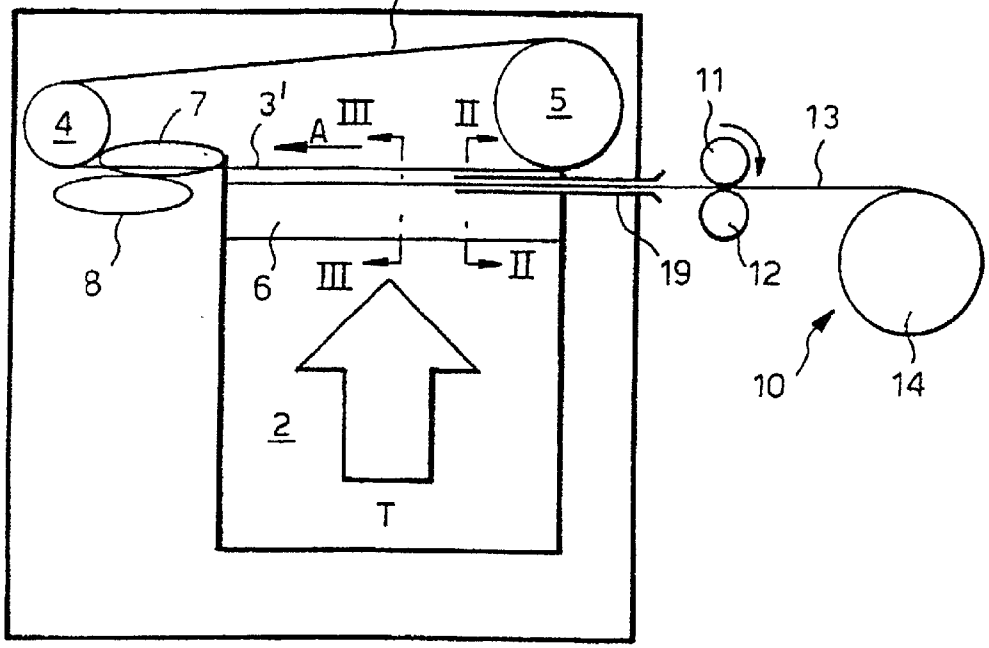
FIG. 3 shows an upstream section of a tobacco rod making machine and associated equipment according to the second aspect of the present invention.

In FIGS. 1 and 3, reference number 1 designates generally a tobacco rod making machine, only an upstream portion of which is shown. The making machine 1 comprises the well known features of an upwardly extending tobacco-feed chimney 2, a foraminous metallic suction band 3 trained about rollers 4 and 5 (one of which is a drive roller), a trough guide 6 and ecreteurs 7 and 8.

In operation of the making machine 1, particulate smoking material in the form of filamentary cut tobacco filler is fed continuously to the lower end of the chimney 2 by conventional feed means (not shown) of the machine 1 and flows upwardly within the chimney 2 (as indicated by arrow T) in an air flow which is maintained under the action of a vacuum which is maintained above lower (deposition) run 3' of the foraminous suction band 3 (thus to produce an upward suction force). At the trough guide 6 the filler is deposited on the underside of the lower run 3' of the suction band 3 and is transported, as a carpet, on the band 3, forwards (leftwards viewing FIGS. 1 and 3, i.e. in the direction of arrow A) to the location of the ecreteurs 7 and 8, which serve to trim filler from the carpet. As is well known to those skilled in the art, downstream of the ecreteurs 7 and 8 the tobacco carpet is fed into a garniture (not shown) of the making machine 1 under the action of a transporting garniture band (also not shown) which acts, in addition, to feed a continuous web of cigarette paper to the garniture. The garniture serves to enwrap the tobacco in the cigarette paper web to provide a continuous tobacco rod. Signals from a rod density monitoring means (also not shown) downstream of the garniture cause position changes of the ecreteurs 7 and 8 such that the amount of tobacco trimmed from the carpet on the suction band 3 is that requisite to maintain the density of the cigarette rod within specified tolerance limits.

In FIGS. 1 and 3 respectively reference numerals 9 and 10 designate generally feed means operable to feed continuous fibriform element 13 to the making machine, which feed means 9, 10 comprise a pair of opposed feed rollers 11, 12. The feed roller 12 is a spring-loaded, non-driven roller, which roller applies a force to the element 13 without deforming the element 13. The feed roller 11 is driven by a servo motor (not shown). Feed rollers 11 and 12 draw the continuous fibriform element 13 from a spool 14 upon which spool 14 the continuous element 13 is wound.

The speed of the feed rollers 11, 12 can be altered by the servo motor. The servo motor is connected electronically to a controller (also not shown), which controller monitors the speed of the driven feed roller 11 in relation to a speed reading received from an encoder device (not shown) which measures the speed of rotation of a drive wheel (not shown) operable to drive an endless garniture tape or belt (also not shown) at the garniture region (also not shown) of the tobacco rod making machine 1. In this manner it is ensured that, the linear speed of the fibriform element 13 being fed to the rod making machine 1 is maintained the same as that of the fully formed tobacco rod issuing from the garniture of the rod making machine 1.

In FIG. 1, the feed rollers 11, 12 feed the continuous fibriform element 13 into a feed tube 15, the mouthpiece of the feed tube 15 being at the nip of the first and second feed rollers 11, 12. The feed tube 15 can be of any suitable length, for example the feed rollers 11, 12 may be substantially juxtaposed with the rod making machine 1 (as depicted in FIG. 1), with the length of the feed tube 15 thus being relatively short. However, alternatively the feed rollers 11, 12 may be remote from the rod making machine 1 and thus the length of the feed tube 15 would be considerably longer. Preferably, the feed tube 15 has a circular cross-sectional conformation having an inner diameter of typically about 1.1 mm when the fibriform element 13 transferred therethrough has an outer diameter of about 1.0 mm.

In order to regulate the speed at which the fibriform element 13 is fed from the spool 14 a brake system may be positioned between the spool 14 and the feed rollers 11, 12 (see FIG. 1). The brake system comprises three rollers (16, 17, 18, two of which, 16, 17, are idling rollers and the third of which, roller 18, is mounted on a spring lever (not shown) and is capable of acting via the lever as a brake in respect of the spindle (not shown) upon which the spool 14 is mounted. If the tensile force exerted by the feed rollers 11, 12 on the element 13 decreases the braking effect in regard to the spool 14 is implemented, thus to prevent a run-off of element 13 from the free running spool 14. Conversely, upon resumption of the application to the element 13 of the original tensile force, the braking effect is automatically removed.

In FIG. 3, the feed rollers 11, 12 feed the continuous element 13 to and through a guide tube 19 disposed within making machine 1.

Figure 2:
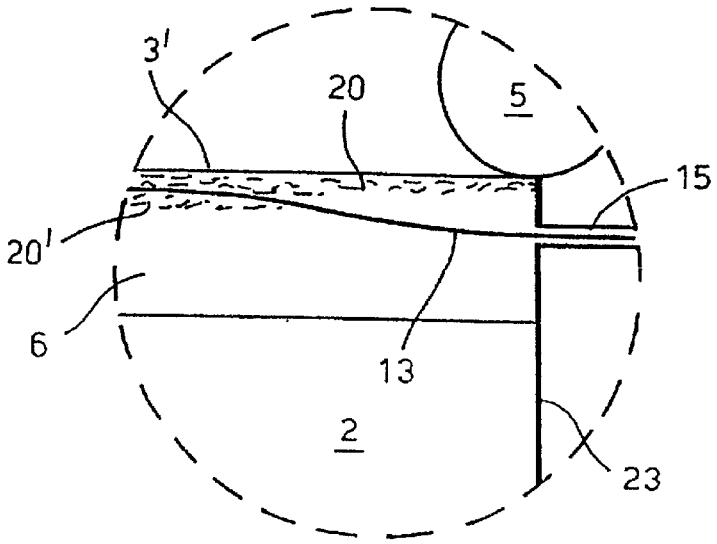
FIG. 2 shows an enlarged longitudinal section of an upstream portion of the guide rails and associated equipment of the apparatus shown in FIG. 1.

FIG. 2 depicts the build-up of filamentary cut tobacco 20 on the lower run 3' of the suction band 3 and the entry of the fibriform element 13 into the trough guide 6 of the rod making machine 1. The trough guide 6 comprises first and second suction band guide rails (not shown but which resemble those depicted in FIG. 5 by reference numerals 21, 22).

Figure 4:
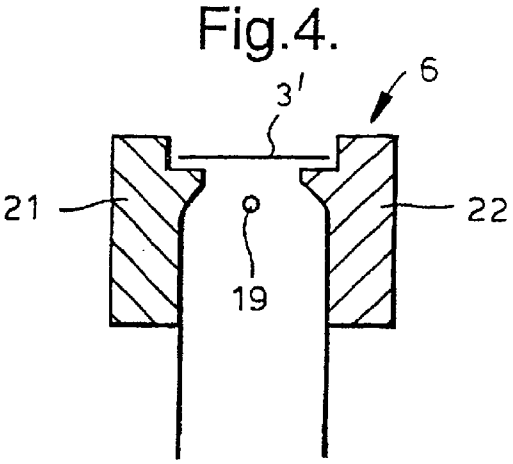
FIG. 4 shows a transverse section, to an enhanced scale, taken at the guide rails and at section II—II of FIG. 3 looking in the direction of the arrows.
Figure 5:
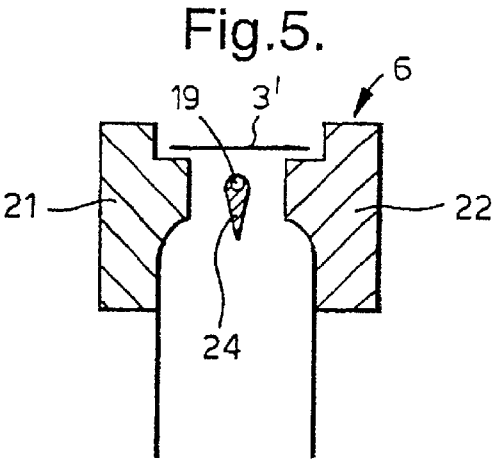
FIG. 5 corresponds to FIG. 4, but depicts a somewhat different arrangement of parts.

As is indicated by FIGS. 4 and 5, the guide means 19 taking the form of a straight rigid guide tube of 1.5 mm exterior diameter, formed, for example, of a stainless steel extends between the guide rails 21 and 22 of the trough guide 6. FIG. 4 shows a transverse section, taken at the guide rails 21 and 22 and at section II—II of FIG. 3 looking in the direction of the arrows, depicting guide rails 21 and 22 which have been modified in shape in the region of the guide tube 19 to ensure an adequate flow of air and filamentary tobacco entrained therein to the suction band 3 notwithstanding the presence of the guide tube 19. The cross-sectional configurations of the unmodified portion of the rails 21 and 22 downstream of the location of the guide tube 19, as viewed at a section taken at III—III of FIG. 3 and looking in the direction of the arrows, are as per those shown for the rails 21 and 22 as depicted in FIG. 5. FIG. 5 further depicts a streamlined fairing 24 extending vertically downwardly from the guide tube 19 so that the flow of air and filamentary tobacco to the suction band 3 is smoothly diverted around the guide tube 19. By ensuring an adequate flow of air and tobacco to the suction band 3 in the region of the guide tube 19, there is thereby achieved the result that the presence of the guide tube 19 does not cause tobacco build-up or blockage. The presence of fairing 24 may further increase the inherent rigidity of the guide tube 19.

Figure 6:
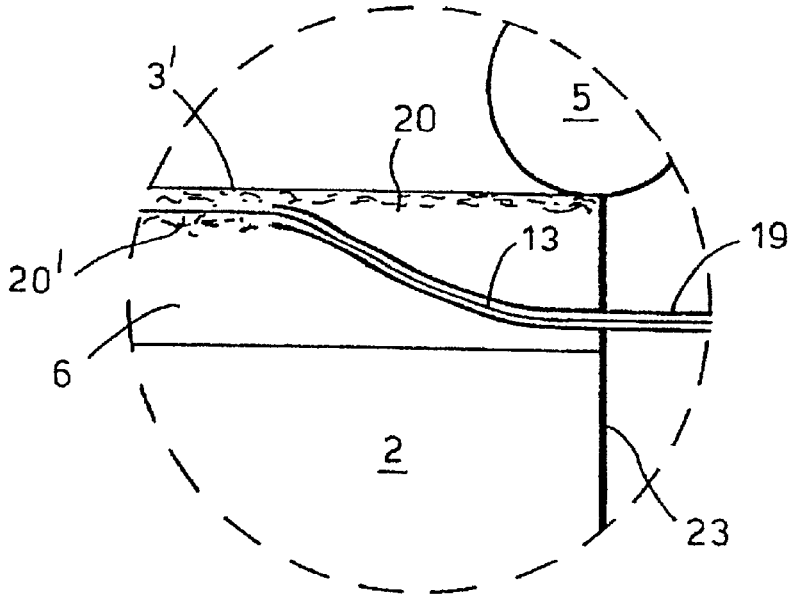
FIG. 6 shows an enlarged longitudinal section of an upstream portion of the guide rails and associated equipment according to an alternative arrangement in accordance with the second aspect of the present invention.
Figure 7:
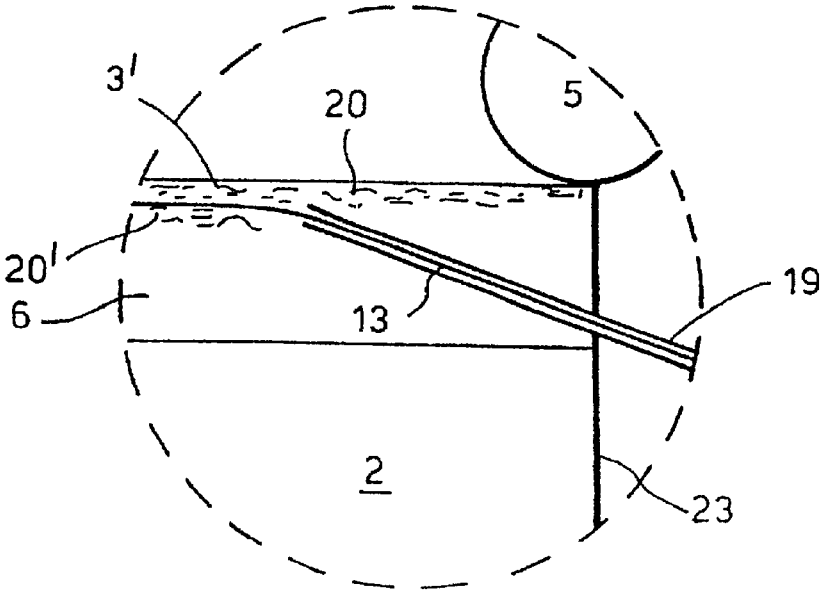
FIG. 7 shows an enlarged longitudinal section of an upstream portion of the guide rails and associated equipment according to a further alternative arrangement in accordance with the second aspect of the present invention.

In FIGS. 6 and,7 the guide tube 19 disposed within the making machine 1 is depicted in alternative arrangements to that shown in FIG. 3. In both FIGS. 6 and 7 the guide tube 19 ascends towards the lower run 3'. In FIG. 6 the path of ascent of the guide tube 19 is of curvilinear ogeed conformation, whereas in FIG. 7 the path of ascent of the guide tube 19 is linear.

In operation of the making machine 1 and the associated feed means 9 of FIG. 1, filamentary cut tobacco filler 20 (see FIG. 2), entrained in conveying air, passes up the chimney 2 and is deposited on the moving lower run 3' of the suction band 3 and, simultaneously therewith, the fibriform element 13 is continuously fed forward by the feed means 9. The element 13 is fed along a feed path which extends between the guide rails of the trough guide 6. The feed tube 15 does not extend beyond side wall 23 of chimney 2 (see FIG. 2).

As is well known to those skilled in the art, the depth of the carpet of filamentary tobacco 20, 20' which is deposited on the lower, deposition run 3' increases proportionately from the right to the left hand of the chimney 2 (as viewing FIGS. 1 and 2). In the rod making machine 1 used to exemplify the invention the trough guide 6 is of a depth of about 20 mm. The fibriform element 13 is fed into the trough guide 6 via the feed tube 15 at a location approximately 7 mm below the lower run 3'. As is depicted in FIG. 2, the fibriform element 13 ascends towards the lower run 3' under the influence of the aforesaid suction force until, at a distance which approximates to 30% of the width of the chimney as taken from the location at which tobacco 20 is first deposited on the run 3', i.e. at the right hand of the chimney as viewing FIG. 2, the fibriform element 13 becomes supported, at a predetermined distance from the run 3', by the tobacco 20 deposited on the run 3'. The element 13 is subsequently maintained at that predetermined distance from the run 3' by the tobacco 20 deposited on the run 3'. After the element has become so supported, further tobacco 20' is deposited on the run 3' and thus tobacco is disposed both above and below the element 13. Suitably, the predetermined distance from the run 3' is about 4 mm in a case in which the resultant tobacco rod is of a diameter of 8 mm, thereby to ensure that the element 19 is disposed coaxially of the rod. Thus, in this case the element 13 ascends a total of about 3 mm over the first 30% of the width of the chimney 2.

In operation of the making machine 1 and the associated feed means 10 as depicted in FIG. 3, filamentary cut tobacco filler, entrained in conveying air, passes up the chimney 2 and is deposited on the moving lower run 3' of the suction band 3 and, simultaneously therewith, the fibriform element 13 is continuously fed forwardly by the feed means 10 and in its travel in a feed path between the guide rails 21, 22 the element 13 is guided by the guide tube 19. In the travel thereof up the chimney 2 in way of the guide tube 19, the filamentary tobacco flows adequately to the run 3' of the suction band 3 by virtue of the provision of flow modifying means, as for example, those as described above with reference to FIG. 4 and/or FIG. 5.

The length dimension of that portion of the guide tube 19 which extends within the chimney 2 is such that the depth of the aforesaid tobacco carpet at the location of the outlet end (the leftward end as viewing FIGS. 3, 6 and 7) of the guide tube 19 is substantially equivalent to the distance by which the guide tube 19, at its outlet end, is spaced from the run 3' of the suction band 3. This being the case, immediately upon the emergence thereof from the guide tube 19, the fibriform element 13 is supported by the tobacco carpet against the suction force acting towards the run 3' of the suction band 3. By virtue of the element 13 being so supported upon emergence from the guide tube 19, it is possible to ensure, by an appropriate specification of the aforesaid length dimension of the guide tube 19 in relation to the width of the chimney 2, that in the subsequently formed tobacco rod the element 13 is disposed co-axially of the rod.

What is claimed is:

1. A method of incorporating a continuous fibriform smoke-modifying element in a smoking material rod, the method, comprising:

providing a smoking material rod-making machine;

including a suction band in said smoking material rod making machine, said suction band having a travel direction, said suction band forming a smoking material deposition run having a start and an end;

applying a suction force to said suction band;

depositing particulate smoking material on said suction band along said smoking material deposition run between said start and said end of said smoking material deposition run;

providing a continuous fibriform smoke-modifying element having a degree of rigidity at a location remote from said smoking material rod-making machine;

providing a longitudinal feed path for said continuous fibriform smoke-modifying element to follow from said remote location to said smoking material rod-making machine, and in said smoking material rod-making machine said longitudinal feed path being in said travel direction of said smoking material deposition run of said suction band of said smoking material rod-making machine;

feeding said continuous fibriform smoke-modifying element to said longitudinal feed path;

causing said longitudinal feed path to be followed by said continuous fibriform smoke-modifying element to start ascending toward said suction band, under the influence of said suction force, at a distance along said smoking material deposition run intermediate said start and end of said smoking material deposition run, said degree of rigidity of said continuous fibriform smoke-modifying element constraining said continuous fibriform smoke-modifying element from being immediately displaced upwardly toward said suction band;

supporting said continuous fibriform smoke-modifying element and maintaining said continuous fibriform smoke-modifying element at a position spaced from said suction band by said particulate smoking material deposited on said suction band before, in said travel direction, said ascending of said longitudinal feed path; and depositing additional particulate smoking material on said suction band along said smoking material deposition run after, in said travel direction, said start of said ascending of said longitudinal feed path.

2. The method according to claim 1 further including selecting said intermediate distance along said deposition run to be in a mid zone of said deposition run between said start of said deposition run and said end of said deposition run.

3. The method according to claim 2 further including selecting said intermediate distance along said deposition run to be located between about 25% and about 60% of a length of said deposition run taken from said start of said deposition run.

4. The method according to claim 3 further including selecting said intermediate distance along said deposition run to be located between about 25% and 40% of said length.

5. The method according to claim 1 further including causing said feed path of said continuous fibriform smoke-modifying element to be ascending at an angle and controlling said angle of said ascending of said feed path of said continuous fibriform smoke-modifying element so that said angle of said ascending of said feed path is not more than about 5 degrees from horizontal.

6. The method according to claim 1 further including feeding said continuous fibriform smoke-modifying element to said smoking material rod-making machine at a fixed speed in relation to a speed at which said smoking material rod-making machine is run.

7. The method of claim 1 further including providing said continuous fibriform smoke-modifying element wound on a spool.

8. The method of claim 7 further including providing a brake system intermediate said spool and said smoking material rod-making machine and using said braking system for regulating a speed of feeding said continuous fibriform smoke-modifying element from said spool to said smoking material rod-making machine.

9. The method of claim 1 further including providing cooperating feed rollers at said location remote from said smoking material rod-making machine and using said feed rollers for feeding said continuous fibriform smoke-modifying element to said longitudinal feed path.

10. A method of incorporating a continuous fibriform smoke-modifying element in a smoking rod material, said method comprising:

providing a smoking material rod-making machine;

including a suction band in said smoking material rod-making machine, said suction band having a travel direction and forming a smoking material deposition run having a start and an end;

applying a suction force to said suction band;

depositing particulate smoking material on said suction band along said smoking material deposition run between said start and said end of said smoking material deposition run;

providing a continuous fibriform smoke-modifying element having a degree of rigidity at a location remote from said smoking material rod-making machine;

providing a longitudinal feed path for said continuous fibriform smoke-modifying element to follow from said remote location to said smoking material rod-making machine and in said smoking material rod-making machine, said longitudinal feed path in said smoking material rod-making machine extending in said travel direction of said smoking material deposition run of said suction band of said smoking material rod-making machine;

providing a guide in said smoking material rod-making machine;

feeding said continuous fibriform smoke-modifying element from said location remote from said smoking material rod-making machine to said guide;

constraining said continuous fibriform smoke-modifying element by said guide in said smoking material rod-making machine to follow said longitudinal feed path spaced from said suction band and to be constrained by said guide and by said degree of rigidity against movement in response to said suction force toward said suction band until a distance along said smoking material deposition run intermediate said start and said end of said smoking material deposition run, said continuous fibriform smoke-modifying element being supported and maintained at a position spaced from said suction band by particulate smoking material deposited on said suction band before, in said travel direction, and by said guide; and depositing additional particulate smoking material on said suction belt along said smoking material deposition run after, in said travel direction, said guide.

11. The method according to claim 10 further including selecting said intermediate distance along said deposition run to be in a mid zone of said deposition run between said start of said deposition run and said end of said deposition run.

12. The method according to claim 11 further including selecting said intermediate distance along said deposition run to be located between about 25% and about 60% of a length of said deposition run taken from said start of said deposition run.

13. The method according to claim 12 further including selecting said intermediate distance along said deposition run to be located between about 25% and 40% of said length.

14. The method according to claim 10 further including feeding said continuous fibriform smoke-modifying element along said longitudinal feed path which extends beneath said smoking material deposition run at a constant vertical distance from said suction band.

15. The method according to claim 10 further including providing said guide having a configuration such that said feed path ascends toward said suction band.

16. The method according to claim 10 further including providing a steamlined fairing on said guide.

17. The method according to claim 10 further including providing a flow path for said particulate smoking material and enlarging said flow path of said particulate smoking material in the vicinity of said guide.

18. The method according to claim 10 further including varying said suction force along said smoking material deposition run overlying said guide relative to said suction force along a remainder of said smoking material deposition run.

19. The method according to claim 10 further including feeding said fibriform element to said smoking material rod-making machine at a fixed speed in relation to a speed at which said smoking material rod-making machine is run.

20. The method of claim 10 further including providing said guide tube having a portion outside of said smoking material rod-making machine.

21. A method for incorporating a continuous fibriform smoke-modifying element in a smoking material rod, said method comprising:

providing a smoking material rod-making machine having a moving suction band having a start and an end;

exerting a suction force on said moving suction band;

using said suction force exerted on said moving suction band for supporting and transporting particulate smoking material deposited on said moving suction band;

feeding a continuous fibriform smoke-modifying element having a degree of rigidity to said smoking material rod-making machine along a longitudinal feed path from a location remote from said smoking material rod-making machine, said longitudinal feed path being generally parallel to a direction of travel of said moving suction band in said smoking material rod-making machine;

entering said continuous fibriform smoke-modifying element into said smoking material-rod making machine along said longitudinal feed path from said remote location at a distance spaced from said moving suction band;

causing said continuous fibriform smoke-modifying element to ascend toward said moving suction band due to said suction force at a location intermediate said start and said end of said moving suction band, said degree of rigidity of said continuous fibriform smoke-modifying element constraining said continuous fibriform smoke-modifying element from being immediately displaced upwardly toward said suction band, said continuous fibriform smoke-modifying element contacting a layer of said particulate smoking material deposited on said moving suction band before said intermediate location; and depositing additional smoking material on said moving suction band and on said continuous fibriform smoke-modifying element subsequent to said intermediate location and subsequent to said entering of said continuous fibriform smoke-modifying element into said smoking material rod machine.

22. A method of incorporating fibriform smoke-modifying material in smoking rod material, said method comprising:

feeding longitudinally a fibriform smoke-modifying material as a sequence of discrete fibriform elements to a rod making machine along a feed path, wherein said feed path in said machine extends in a travel direction of a smoking material deposition run of a suction band of said machine;

constraining said fibriform material by a guide in said machine so that said fibriform material follows said feed path spaced from said run of said suction band and is constrained against a suction force toward said run until at a distance along said deposition run said fibriform material becomes supported and is subsequently maintained at a position spaced from said run by a particulate smoking material deposited on said run; and depositing additional smoking material on said run.

23. A method of incorporating a continuous fibriform smoke-modifying element in a smoking rod material, said method comprising:

feeding longitudinally a continuous fibriform smoke-modifying element having a degree of rigidity to a smoking material rod-making machine along a feed path from a location remote from said smoking material rod-making machine, said feed path, in said machine, extending in a travel direction of a smoking material deposition run of a suction band of said machine and said feed path, in said machine, ascending toward said smoking material deposition run;

providing a guide for said continuous fibriform smoke-modifying element in said rod making machine;

constraining said continuous fibriform smoke-modifying element by using said guide in said machine so that said continuous fibriform smoke-modifying element follows said feed path spaced from said run of said suction band and is constrained by said guide and by said degree of rigidity against a suction force exerted by said suction band and directed toward said run until at a distance along said deposition run said continuous fibriform smoke-modifying element becomes supported and is subsequently maintained at a position spaced from said run by a particulate smoking material deposited on said run; and depositing additional smoking material on said run subsequent to said distance as which said continuous fibriform smoke-modifying element is supported by a particulate smoking material deposited on said run.

24. A method of incorporating a continuous fibriform smoke-modifying element in smoking rod material, said method comprising;

feeding longitudinally a continuous fibriform smoke-modifying element having a degree of rigidity to a smoking material rod-making machine along a feed path from a location remote from said smoking material rod-making machine, said feed path, in said machine, extending in a travel direction of a smoking material deposition run of a suction band of said machine;

providing a guide for said continuous fibriform smoke-modifying element in said rod making machine;

constraining said continuous fibriform smoke-modifying element by using said guide in said machine so that said continuous fibriform smoke-modifying element follows said feed path spaced from said run of said suction band and is constrained by said guide and by said guide and by said degree of rigidity against a suction force exerted by said suction band and directed toward said run until at a distance along said deposition run said continuous fibriform smoke-modifying element becomes supported and is subsequently maintained at a position spaced from said run by a particulate smoking material deposited on said run;

providing a streamlined fairing on said guide; and depositing additional smoking material on said run.

25. A method of incorporating a continuous fibriform smoke-modifying element in smoking rod material, said method comprising;

feeding longitudinally a continuous fibriform smoke-modifying element having a degree of rigidity to a smoking material rod-making machine along a feed path from a location remote from said smoking material rod-making machine, said feed path, in said machine, extending in a travel direction of a smoking material deposition run of a suction band of said machine;

providing a guide for said continuous fibriform smoke-modifying element in said rod making machine;

constraining said continuous fibriform smoke-modifying element by using said guide in said machine so that said continuous fibriform smoke-modifying element follows said feed path spaced from said run of said suction band and is constrained by said guide and by said degree of rigidity against a suction force exerted by said suction band and directed toward said run until at a distance along said deposition run said continuous fibriform smoke-modifying element becomes supported and is subsequently maintained at a position spaced from said run by a particulate smoking material having a flow path and being deposited on said run;

enlarging said flow path of said particulate smoking material in a vicinity of said guide; and depositing additional smoking material on said run.

26. A method of incorporating a fibriform smoke-modifying element in smoking rod material, said method comprising:

feeding longitudinally a continuous fibriform smoke-modifying element having a degree of rigidity to a smoking material rod-making machine along a feed path from a location remote from said smoking material rod-making machine, said feed path, in said machine, extending in a travel direction of a smoking material deposition run of a suction band of said machine, said suction band being provided with a suction force;

providing a guide for said continuous fibriform smoke-modifying element in said rod making machine;

constraining said continuous fibriform smoke-modifying element by using said guide in said machine so that said continuous fibriform smoke-modifying element follows said feed path spaced from said run of said suction band and is constrained by said guide and by said degree of rigidity against said suction force toward said run until at a distance along said deposition run said continuous fibriform smoke-modifying element becomes supported and is subsequently maintained at a position spaced from said run by a particulate smoking material deposited on said run;

varying said suction force at said portion of said smoking material deposition run adjacent said guide relative to said suction force over a remainder of said smoking material deposition run; and depositing additional smoking material on said run.

* * * * *